US005244315A

United States Patent [19]

Kitanaka et al.

[11] Patent Number: 5,244,315

[45] Date of Patent: Sep. 14, 1993

[54] EXCAVATOR FOR CONSTRUCTING UNDERGROUND CONTINUOUS WALL AND UNDERGROUND CONTINUOUS WALL CONSTRUCTION METHOD

[75] Inventors: Katsumi Kitanaka; Takehiko Kitanaka, both of Tokyo, Japan

[73] Assignee: Hokushin Kogyo Corporation, Tokyo, Japan

[21] Appl. No.: 909,187

[22] Filed: Jul. 6, 1992

[30] Foreign Application Priority Data

Apr. 1, 1992 [JP] Japan ..... 4-79850

[51] Int. Cl.[5] ..... E02D 5/18

[52] U.S. Cl. ..... 405/267; 405/266; 405/287; 405/287.1; 37/357; 37/464; 37/347

[58] Field of Search ..... 405/267, 266, 270, 236, 405/287, 286, 287.1; 37/84, 87, 90, 80 A, 105, 104, 191 A, 192 A, 80 R

[56] References Cited

U.S. PATENT DOCUMENTS

| | | | |
|---|---|---|---|
| 4,379,658 | 4/1983 | Schmednecht | 37/80 R X |
| 4,858,344 | 8/1989 | Cotsford | 37/104 |
| 4,861,199 | 8/1989 | Hackmack | 37/191 A X |
| 4,909,674 | 3/1990 | Konno et al. | 405/267 |
| 5,022,792 | 6/1991 | Konno et al. | 405/267 |
| 5,056,242 | 10/1991 | Miotti | 405/267 X |
| 5,113,609 | 5/1992 | Camilleri | 37/87 |

*Primary Examiner*—Dennis L. Taylor
*Assistant Examiner*—J. Russell McBee
*Attorney, Agent, or Firm*—Stevens, Davis, Miller & Mosher

[57] ABSTRACT

An excavator for constructing an underground continuous wall includes a traveling trolley movable on rails and having a sprocket in mesh with a rack extended parallelly to the rails and a hydraulic motor for driving the sprocket. The trolley further includes an upper frame arranged thereon and having a tiltable frame tiltable relative to the upper frame and a saddle provided on the tiltable frame slidable on the tiltable frame in directions substantially perpendicular to the rails. An extensible guide post is provided upward and downward movably relative to the tiltable frame. An endless chain extends around a chain driving wheel provided on the saddle and a chain sprocket provided at the lower end of the guide post, and a number of cutter bits and a number of agitator bars are alternately arranged on the endless chain to form an endless chain cutter. A chain driving device is provided for driving the endless chain.

9 Claims, 8 Drawing Sheets

1
46
47
47
4
G
1
C
C
29
24
29
C
47
49
48
49
49
48
C
C
49
47
C

I
46
47
H
C
K
29
24
49
48

46
47
J
I
C
L
50
49
48

EXCAVATOR FOR CONSTRUCTING UNDERGROUND CONTINUOUS WALL AND UNDERGROUND CONTINUOUS WALL CONSTRUCTION METHOD

BACKGROUND OF THE INVENTION

This invention relates to an excavator for excavating ground to construct an underground continuous wall, and underground continuous wall construction methods using the excavator in civil engineering and construction works.

In constructing such an underground continuous wall according to a prior art technique, first a hole of an elliptical section having a 2 to 3 m major axis is dug in the ground to a predetermined depth by a powerful bucket or a hole is dug to a predetermined depth by two or three series of auger drills. After the hole formed in slurry is sealed with a bentonite solution to prevent further penetration of slurry, a reinforcing bar cage is placed in the hole and a ready mixed-concrete is then poured into the hole to form a foundation column. Such a method is repeated to form an underground continuous wall.

With the underground continuous wall construction method of the prior art described above, the processes are complicated and hence take much time until the completion of the continuous walls. Moreover, slurry or bentonite solution layers at joints between successive columns interrupt the formation of the continuous wall so that after completion of the wall, ground water tends to leak into the inside of the continuous walls through the joints. It is therefore very difficult to provide the underground continuous wall simultaneously having two functions as a foundation wall and a diaphragm wall.

SUMMARY OF THE INVENTION

It is, therefore, an object of the invention to provide an excavator for constructing an underground continuous wall in simple processes in a short construction period, which wall is substantially smoothly continuous to have two functions as the foundation wall and the diaphragm wall.

It is another object of the invention to provide construction methods for constructing the underground continuous wall, which can easily and rapidly construct the underground continuous wall without joints and without any risk of leakage of ground water.

In order to accomplish the first object, the excavator for constructing the underground continuous wall according to the invention, comprises a traveling trolley movable on rails and having at least one sprocket in mesh with a rack provided on one of the rails and sprocket driving means for driving the sprocket, an upper frame arranged on the trolley and having a tiltable frame which is tiltable about its lower portion relative to the upper frame, a saddle provided on the tiltable frame so as to be slidable thereon in directions substantially perpendicular to the rails and having a chain driving wheel, an extensible guide post positioned below the chain driving wheel to be upward and downward movable relative to the tiltable frame and having a chain sprocket rotatably connected to the lower end of the guide post, an endless chain extending around the chain sprocket and the chain driving wheel on the saddle, a number of cutter bits and a number of agitator bars alternately arranged on the endless chain to form an endless chain cutter, and chain driving means for driving the endless chain.

In another aspect, in the underground continuous wall construction method using the excavator described above, the method according to the invention comprises steps of digging a hole in the ground to a predetermined depth by means of a drilling device, inserting the endless chain cutter of the excavator into the hole, and excavating the ground in a predetermined direction by means of the endless chain cutter, while jetting a hardening liquid such as cement milk in the excavated hole, thereby mixing the hardening liquid with the earth and sand in the excavated hole to form a soil cement wall.

Moreover, the underground continuous wall construction method using the excavator according to the invention comprises steps of digging a hole in the ground to a predetermined depth by means of a drilling device, inserting the endless chain cutter of the excavator into the hole, and excavating the ground in a predetermined direction by means of the endless chain cutter, while inserting an agitator substantially similar in construction to the endless chain cutter and having a hardening liquid injection pipe to jet a hardening liquid in the excavated hole, thereby mixing the hardening liquid with the earth and sand in the excavated hole to form a soil cement wall.

Furthermore, the underground continuous wall construction method using the excavator according to the invention comprises steps of digging a hole in the ground to a predetermined depth by means of a drilling device, inserting the endless chain cutter of the excavator into the hole, and excavating the ground in a predetermined direction by means of the endless chain cutter and removing the excavated earth and sand, while inserting an injection pipe behind the endless chain cutter to jet a hardening liquid mixed with the removed earth and sand into the excavated hole, thereby filling the excavated hole with any one of soil cement and soil mortar.

In constructing underground continuous walls by the use of the excavator according to the invention, first a hole is digged in the ground to a predetermined depth, and the endless chain cutter is assembled in the hole. The endless chain of the endless chain cutter is then driven, while the traveling trolley is advanced to excavate the ground to form one side an underground wall. While excavating is being effected, one of the construction methods described above is carried out to construct the underground continuous wall. The excavator and the construction methods have the following significant effects.

According to the invention, the traveling trolley is moved with the aid of the rack provided on one of the rails in parallel therewith and the driving sprocket provided on the trolley to be meshed with the rack. Therefore, the trolley can be powerfully and securely driven without slipping relative to the rails.

According to the invention, moreover, on one side of the upper frame arranged on the trolley the tiltable frame is provided whose lower portion is rotatably connected to the trolley to permit the upper portion of the tiltable frame to be lockable, and on the tiltable frame a saddle is provided slidably in the directions perpendicular to the rails. Further, the driving wheel for driving the endless chain is provided on the saddle, and the guide post is provided on the tiltable frame movably upward and downward relative thereto and arranged below the driving wheel. The guide post is extensible by joining spare members to it. Therefore, the inclination of the endless chain cutter including the guide post as a main member can be exactly adjustable relative to the ground. Moreover, the length of the endless chain cutter can be easily adjustable by connecting extension post members to the guide post.

Furthermore, according to the invention, the guide post is provided with the chain sprocket rotatable at its lower end, and the endless chain extends around the chin sprocket and the chain driving wheel provided on the saddle. Moreover, a number of cutter bits and a number of agitator bars are alternately arranged on the endless chain to form an endless chain cutter. The endless chain is adapted to be driven and the trolley is also adapted to be driven. By the use of the excavator according to the invention, therefore, high accuracy underground continuous walls can be constructed with very high efficiency.

Furthermore, the excavator according to the invention has the long underground portion and a short portion above the ground surface so that constructional stability is high and hence there is no risk of falling down, thereby insuring the safety in working.

According to the construction methods of the invention, it is possible to excavate the ground continuously and at the same time to construct the underground continuous wall of soil cement or cement mortar continuously in the space immediately after being excavated. Moreover, as the underground continuous wall constructed by the methods according to the invention have smooth surfaces without any joints in wall surfaces so that there is no risk of ground water leaking through the wall surfaces. Therefore, the construction methods according to the invention is able to construct a foundation wall in the ground and at the same time enables the foundation wall to be used as a diaphragm wall.

The invention will be more fully understood by referring to the following detailed specification and claims taken in connection with the appended drawings.

DESCRIPTION OF THE PREFERRED EMBODIMENTS

Figure 1:
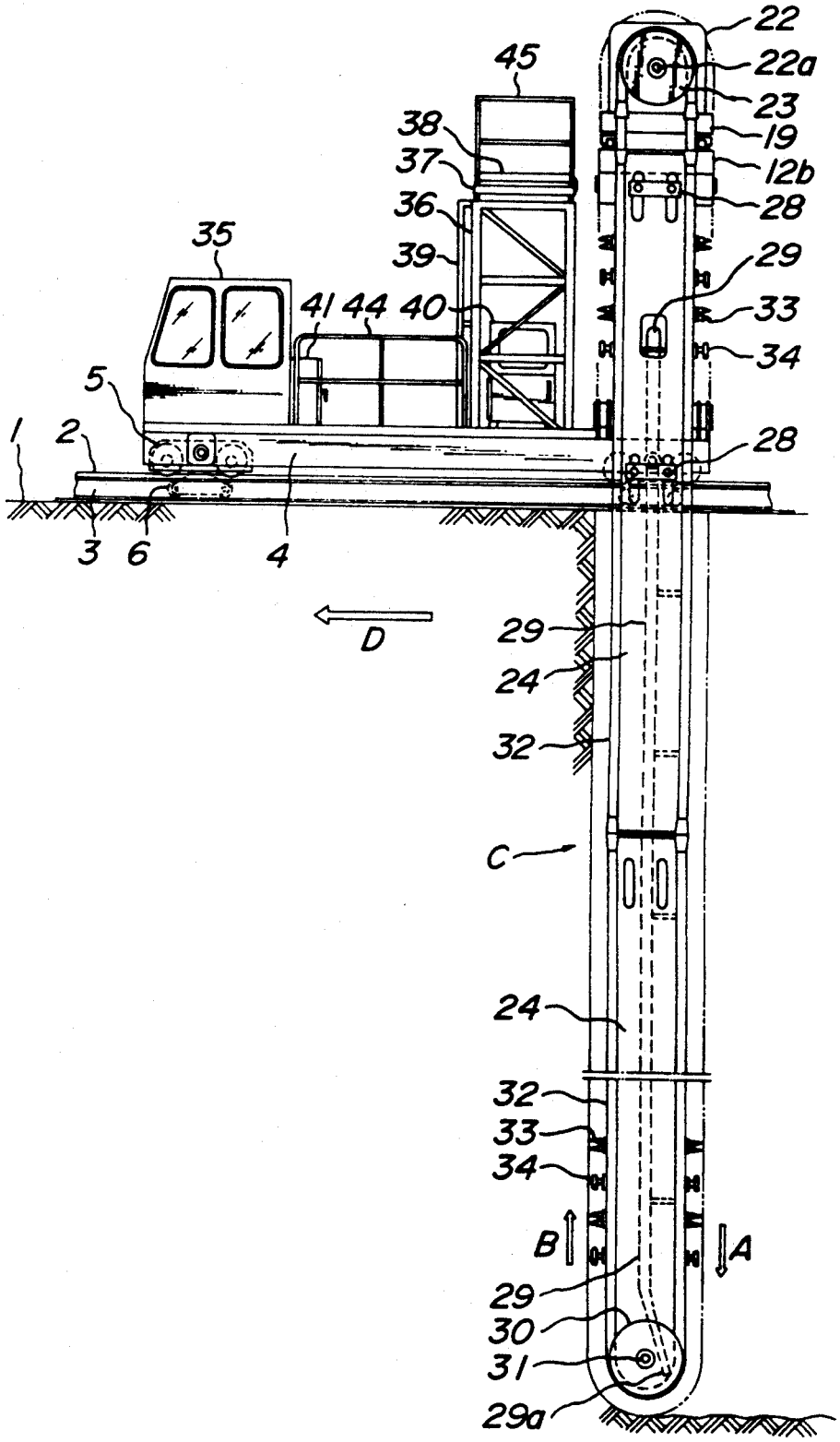
FIG. 1 is a side view of the excavator according to the invention.

Referring to the drawings, reference numeral 1 denotes a ground or foundation to be constructed therein with a continuous wall. In the illustrated embodiment, a lower frame 3 is arranged on the ground 1 along an underground continuous walls to be formed, and two rails 2 are arranged on the lower frame 3. A traveling trolley 4 is movably located on the rails 2. The traveling trolley 4 has wheels 5 rolling on the rails 2 and rollers 6 to be fitted in the lower frame 3 for preventing the trolley 4 from falling down. A pin rack 7 is provided on one of the rails 2 in parallel therewith (FIGS. 2 and 3), while a sprocket 8 is provided on the trolley 4 so as to be in mesh with the pin rack 7 and driven by a hydraulic motor 9.

An upper frame 10 (FIG. 2) is mounted on the trolley 4. The upper frame 10 is provided on its one side (its left side viewed in FIG. 2) with a tiltable frame 12 whose lower end is pivotally connected to the trolley 4 so as to permit the upper portion of the frame 12 to be tilted. In order to tilt the tiltable frame 12, the upper frame 10 is provided thereon with a hydraulic motor 13, a reduction device 14 connected thereto, a screw shaft 15 rotatable relative to the upper frame 10 and driven by the hydraulic motor 13 through the reduction device 14, a nut 16 adapted to be threadedly engaged on the screw shaft 15, and a link 17 connecting the nut 16 and the upper portion **12*a* of the tiltable frame 12**.

Figure 2:
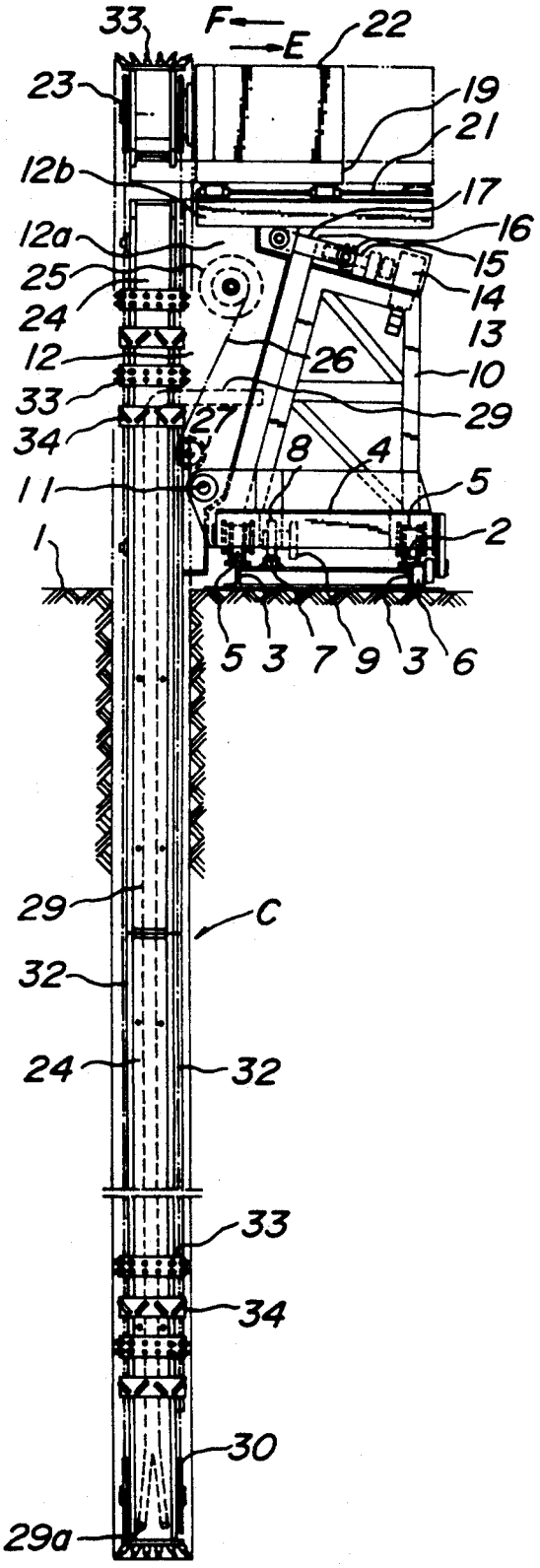
FIG. 2 is a front view of the excavator shown in FIG. 1.
Figure 3:
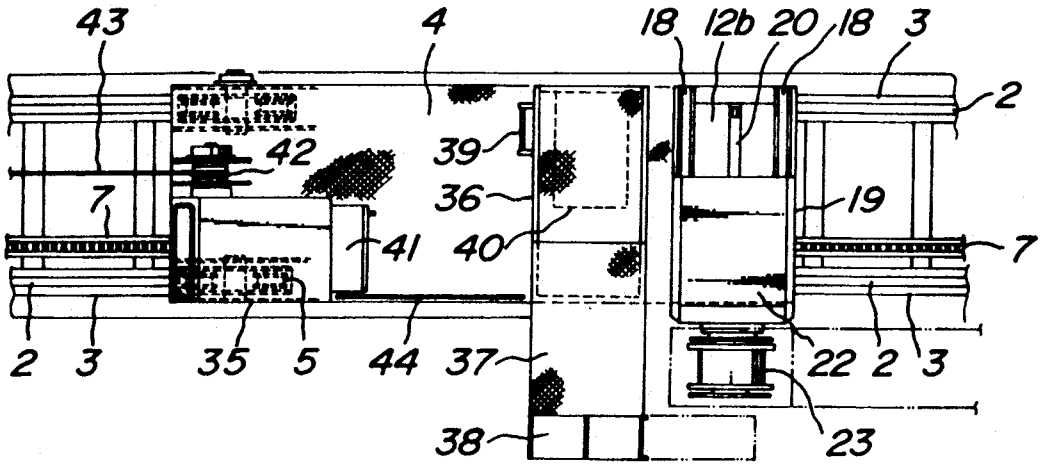
FIG. 3 is a plan view of the excavator shown in FIG. 1.

A horizontal base **12*b* is provided on the upper portion 12*a* of the tiltable frame 12. Two rails 18 (FIG. 3) are provided on the horizontal base 12*b* in the direction perpendicular to the rails 2. A saddle 19 is slidably arranged on the rails 18 and adapted to be driven by a hydraulic cylinder 20 (FIG. 3) and guided by a limit guide 21 (FIG. 2). On the saddle 19 is provided a hydraulic motor 22 having an output shaft 22*a* to which is fixed a driving wheel 23 for driving an endless chain (later described). A guide post 24 is extensible by connecting extension post members to the post 24 and is provided below the driving wheel 23 vertically movably with the aid of the wire 26 of a hydraulic winch 25 provided on the tiltable frame 12. A guide pulley 27 for the wire 26 of the winch 25 is provided on the tiltable frame 12. The guide post 24 is fixed to the tiltable frame 12 by means of a post fixing block 28. An injection pipe 29 for pouring mortar extends from the upper frame 10 into the guide post 24 and has branched lower ends 29*a* opening at the lower end of the guide post 24**.

Figure 4A:
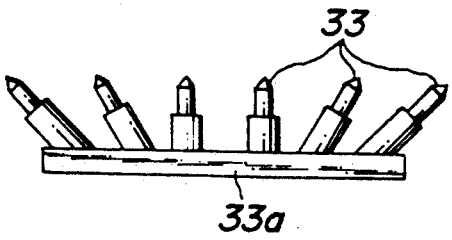
FIGS. 4*a*, 4*b* and 4*c* are front, plan and side views of one example of cutter bits used in the endless chain cutter of the excavator according to the invention, respectively.
Figure 4C:
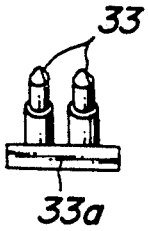
Figure 4B:
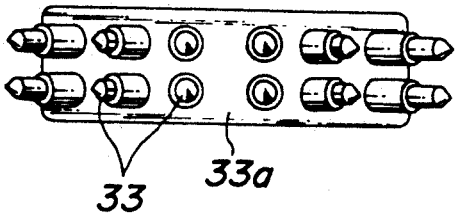
Figure 5A:
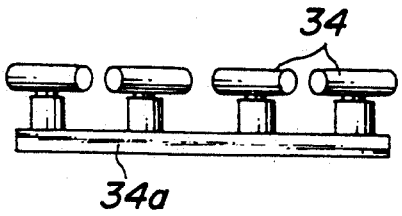
FIGS. 5*a*, 5*b* and 5*c* are front, plan and side views of one example of agitator bars used in the endless chain cutter of the excavator according to the invention, respectively.
Figure 5C:
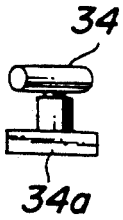
Figure 5B:
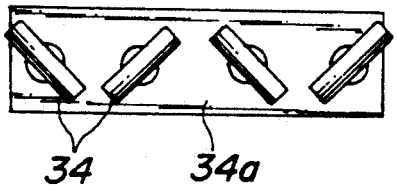

A chain sprocket 30 is rotatably supported on the lower end of the guide post 24 by means of a pin 31. An endless chain 32 extends the chain sprocket 30 and the driving wheel 23 on the saddle 19. A number of cutter bits 33 and a number of agitator bars 34 are alternately arranged on the endless chain 32 to form an endless chain cutter C. A plurality of cutter bits 33 are fixed to a base plate **33*a* which is fixed to each of links of the endless chain 32. One example of arrangements of the cutter bits 33 is shown in FIGS. 4*a*, 4*b* and 4*c*. Plural cutter bits 33 are fixed to a base plate 33*a* which is fixed to each of links of the endless chain 32. A plurality of agitator bars 34 are fixed to a base plate 34*a* which is fixed to each of links of the endless chain 32. One example of arrangements of the agitator bars 34 is shown in FIGS. 5*a*, 5*b* and 5*c*. Plural agitator bars 34 are fixed to a base plate 34*a* which is fixed to each of links of the endless chain 32**.

The traveling trolley 4 includes an operator's cabin 35, a side frame 36 provided adjacent to the upper frame 10, a slide deck 37 slidably movable on the side frame 36, a collapsible deck 38 on the slide deck 37, a ladder 39 attached to the side frame 36 for going up to its top, a hydraulic unit 40 arranged in the side frame 36, a control unit 41, a power cable 43 wound around a reel 42, and handrails 44 and 45.

In constructing an underground continuous wall by the use of the excavator constructed described above, first a vertical hole 47 having a predetermined depth is dug in the ground at a position where the underground continuous wall is to be formed by means of earth drills 46 or the like as shown in FIGS. 6*a*–6*e*, 7*a*–7*d* and 8*a*–8*e*. The endless chain cutter C having a desired length is then assembled and placed in the vertical hole 47. Thereafter, the chain 32 of the endless chain cutter C is driven by means of the hydraulic motor 22 in directions shown by arrows A and B in FIG. 1, while the traveling trolley 4 is advanced in the direction shown by an arrow D in FIG. 1 by driving the sprocket 8 in mesh with the pin rack 7 by means of the hydraulic motor 9 to form a continuous groove in the ground 1.

In assembling the endless chain cutter C, after the saddle 19 has been moved in the direction shown by an arrow E in FIG. 2, the guide post 24 joined with some spare members to have a desired length is hung in front of the tiltable frame 12. The hung guide post 24 is then inserted into the vertical hole 47. After the height of the guide post 24 has been adjusted by means of the wire 26 and the hydraulic winch 25, the guide post 24 is fixed through the fixing block 28 to the tiltable frame 12. When the hydraulic motor 13 having the reduction device 14 is actuated to rotate the screw shaft 15 threadedly engaged with the nut 16, the nut and the link 17 connected thereto are moved to tilt the tiltable frame 12 about the pin 11, thereby adjusting the inclination of the guide post 24. Consequently, the guide post 24 can be vertically maintained exactly.

After the guide post 24 has been fixed in position in the manner described above, the saddle 19 is moved by means of the hydraulic cylinder 20 in the direction shown by an arrow F in FIG. 2 to arrange the driving wheel 23 directly above the guide post 24. At this time, the endless chain 32 has been already supported by the guide post 24 and extending around the chain sprocket 30 provided at the lower end of the guide post 24. The endless chain 32 also extends around the driving wheel 23 immediately above the guide post 24 to complete the endless chain cutter C.

Figures 6A, 6B, 6C, 6D, 6E:
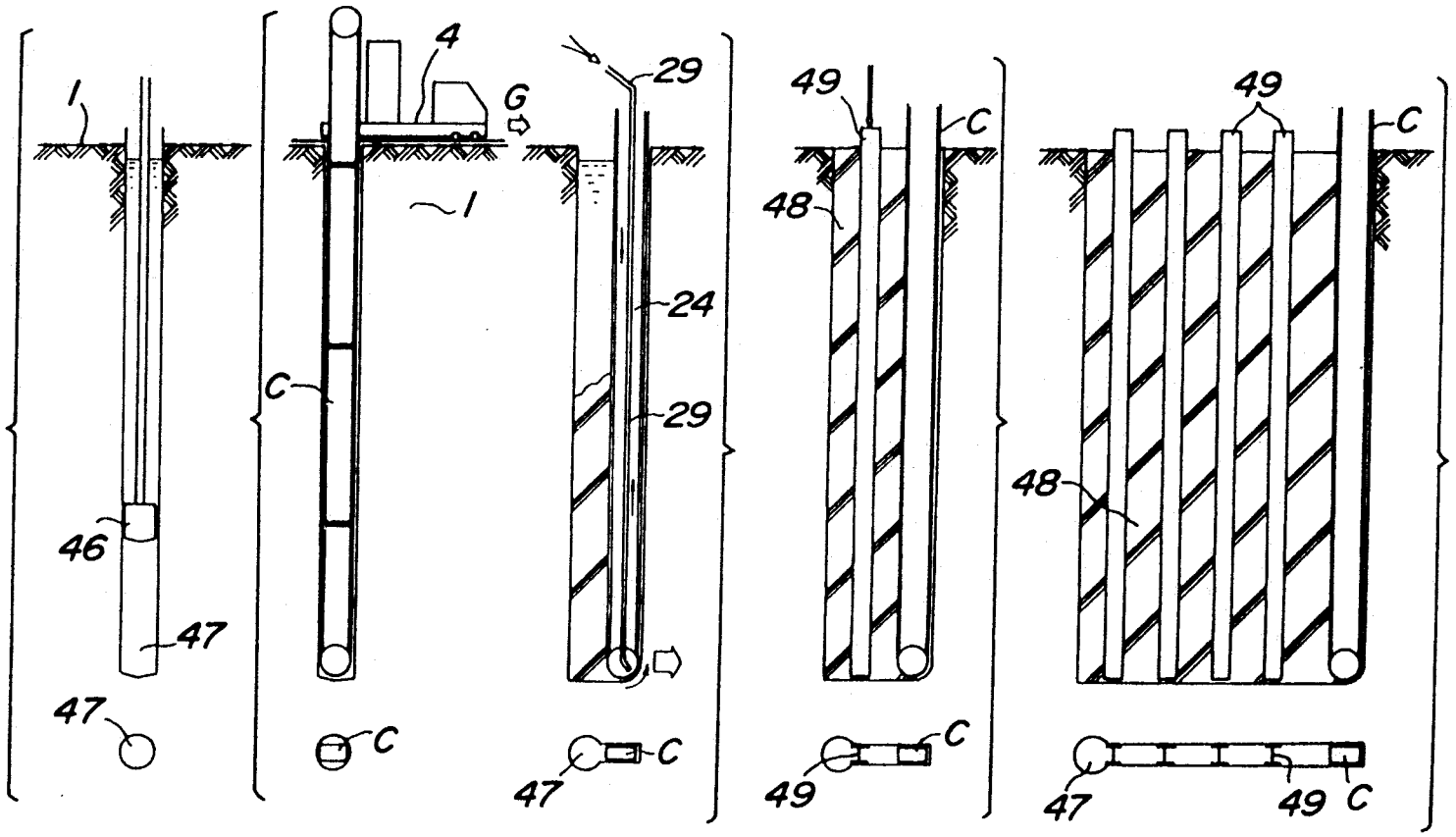
FIGS. 6*a*, 6*b*, 6*c*, 6*d* and 6*e* are views illustrating the processes of the first construction method according to the invention.

FIGS. 6*a* to 6*e* illustrate the first construction method according to the invention. A figure at the bottom of each of FIGS. 6*a* to 6*e* schematically shows a cross section of the ground. First, a hole 47 is dug in the ground 1 to a predetermined depth by means of a boring device 46 such as an earth drill as shown in FIG. 6*a*. The endless chain cutter C of the excavator according to the invention is then inserted into the hole 47. Thereafter the trolley is driven in the predetermined direction shown by an arrow G in FIG. 6*b* to excavate the ground 1, while a hardening liquid such as cement milk is jetted into the excavated hole through the injection pipe 29 provided in the guide post 24 of the endless chain cutter C as shown in FIG. 6*c*. As a result, the hardening liquid is mixed with earth and sand in the excavated hole to form a soil cement wall 48 as shown in FIGS. 6*c*, 6*d* and 6*e*. Reference numeral 49 illustrates H-beams inserted in the soil cement wall 48 with suitable intervals by hanging the H-beams 49 before the soil cement wall 48 have hardened.

Figures 7A, 7B, 7C, 7D:
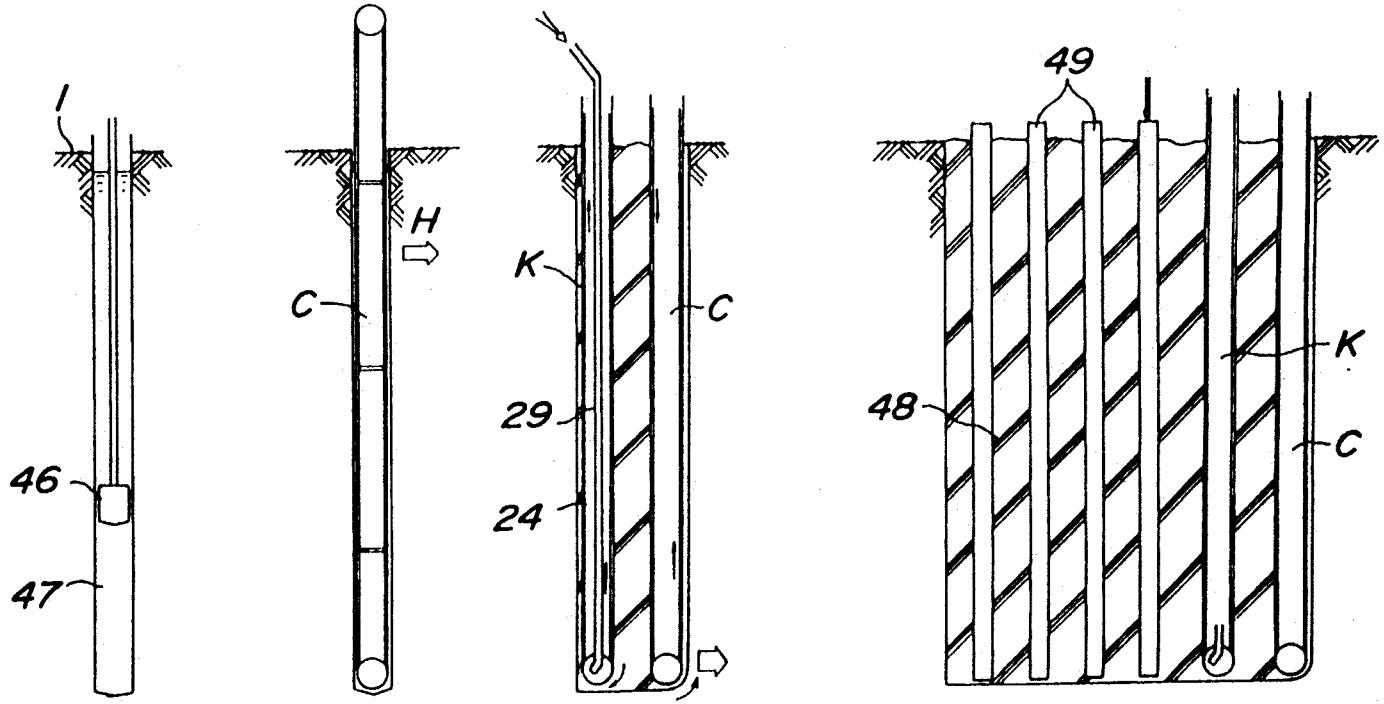
FIGS. 7*a*, 7*b*, 7*c* and 7*d* are views illustrating the processes of the second construction method according to the invention.

FIGS. 7*a* to 7*d* illustrate the second construction method according to the invention. First, an agitator K is prepared, which is substantially similar in construction to the endless chain cutter C and includes an injection pipe 29 provided in a guide post 24 for pouring a hardening liquid. A hole 47 is dug in the ground 1 to a predetermined depth by means of a boring device 46 such as an earth drill as shown in FIG. 7*a*. The endless chain cutter C of the excavator according to the invention is then inserted into the hole 47. Thereafter the trolley is driven in the predetermined direction shown by an arrow H in FIG. 7*b* to excavate the ground 1, while the agitator K is inserted behind the endless chain cutter C and a hardening liquid is jetted through the injection pipe 29 of the agitator K as shown in FIG. 7*c* to mix the hardening liquid with earth and sand in the excavated hole to form a soil cement wall 48 as shown in FIG. 7*d*. Reference numeral 49 illustrates H-beams inserted in the soil cement wall 48 with suitable intervals by hanging the H-beams 49 before the soil cement wall 48 have hardened.

Figures 8A, 8B, 8C, 8D, 8E:
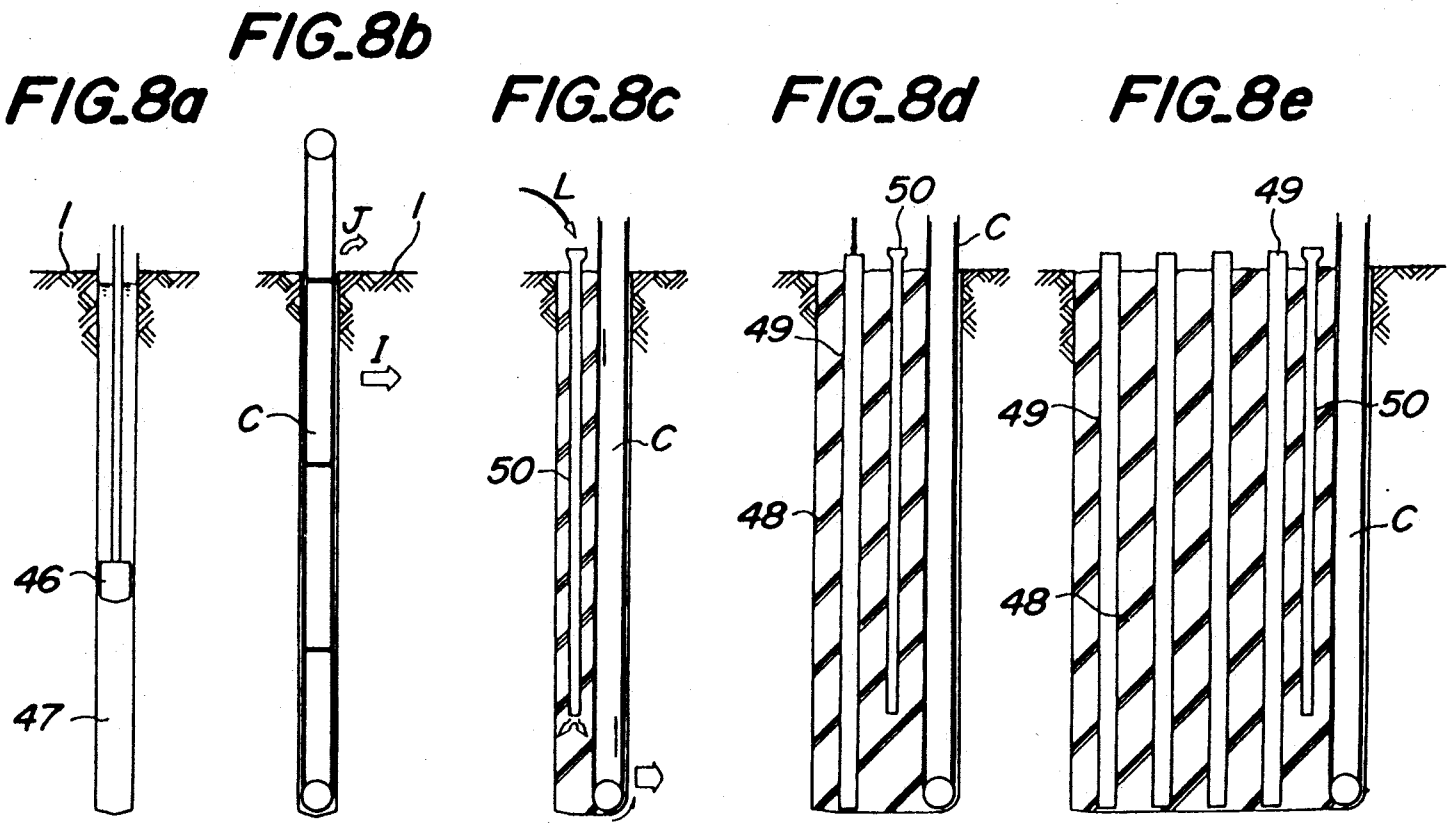
FIGS. 8*a*, 8*b*, 8*c*, 8*d* and 8*e* are views illustrating the processes of the third construction method according to the invention.

FIGS. 8*a* to 8*e* illustrate the third construction method according to the invention. First, a hole 47 is dug in the ground 1 to a predetermined depth by means of a boring device 46 such as an earth drill as shown in FIG. 8*a*. The endless chain cutter C of the excavator according to the invention is then inserted into the hole 47 as shown in FIG. 8*b*. Thereafter, the trolley is driven in the predetermined direction shown by an arrow I in FIG. 8*b* to excavate the ground 1 and remove the earth and sand as shown by an arrow J in FIG. 8*b*, while an injection pipe 50 is inserted behind the endless chain cutter C and a hardening liquid mixed with the removed earth and sand is poured through the injection pipe 50 into the excavated hole as shown by L in FIG. 8*c*. As a result, the excavated hole is filled with soil cement or soil mortar to form a wall 48 as shown in FIGS. 8*d* and 8*e*. Reference numeral 49 illustrates H-beams inserted in the soil cement wall 48 with suitable intervals by hanging the H-beams 49 before the soil cement wall 48 have hardened.

As can be seen from the above explanation, with the traveling trolley provided with the driving sprocket in mesh with the rack provided on one of the rails arranged on the ground, the trolley can be powerfully and securely driven without slipping relative to the rails. Moreover, the inclination of the endless chain cutter of the excavator according to the invention can be exactly adjustable relative to the ground and length of the endless chain cutter can be easily adjusted by connecting extension post members to the guide post. By the use of the excavator according to the invention, an underground continuous wall can be constructed in high accuracy and with very high efficiency. Moreover, the excavator according to the invention is high in constructional stability and hence there is no risk of falling down. Furthermore, according to the construction methods of the invention, it is possible to construct a foundation wall in the ground which is able to be used as a diaphragm wall also.

While the invention has been particularly shown and described with reference to preferred embodiments thereof, it will be understood by those skilled in the art that the foregoing and other changes in form and details can be made therein without departing from the scope of the invention.

What is claimed is:

1. An excavator for constructing an underground continuous wall, comprising a traveling trolley movable on rails and having at least one sprocket in mesh with a rack provided on the rails, driving means for driving the sprocket, an upper frame arranged on the trolley, a tiltable frame pivoted at its lower portion to the upper frame, a chain driving wheel on a saddle on said tiltable frame, means for sliding said saddle on said tiltable frame in a direction substantially perpendicular to the rails, an extensible guide post vertically supported by the tiltable frame and positioned below the chain driving wheel, a chain sprocket rotatably connected to the lower end of the guide post, an endless chain extending around the chain sprocket and the chain driving wheel, and a number of cutter bits and a number of agitator bars alternately arranged on the endless chain to form an endless chain cutter.

2. The excavator as claimed in claim 1, wherein the endless chain cutter comprises an injection pipe extending from the upper frame into the guide post and having branched lower ends opening at the lower end of the guide post.

3. An underground continuous wall construction method utilizing an excavator comprising a traveling trolley movable on rails and having at least one sprocket in mesh with a rack provided on the rails, driving means for driving the sprocket, an upper frame arranged on the trolley, a tiltable frame pivoted at its lower portion to the upper frame, a chain driving wheel on a saddle on said tiltable frame, means for sliding said saddle on said tiltable frame in a direction substantially perpendicular to the rails, an extensible guide post vertically supported by the tiltable frame and positioned below the chain driving wheel, a chain sprocket rotatably connected to the lower end of the guide post, an endless chain extending around the chain sprocket and the chain driving wheel, and a number of cutter bits and a number of agitator bars alternately arranged on the endless chain to form an endless chain cutter;

said method comprising the steps of digging a hole in the ground to a predetermined depth by means of a drilling device, inserting the endless chain cutter of the excavator into the hole, and excavating the ground in a predetermined direction by means of the endless chain cutter, while jetting a hardening liquid in the excavated hole, thereby mixing the hardening liquid with the earth and sand in the excavated hole to form a soil cement wall.

4. An underground continuous wall construction method utilizing an excavator comprising a traveling trolley movable on rails and having at least one sprocket in mesh with a rack provided on the rails, driving means for driving the sprocket, an upper frame arranged on the trolley, a tiltable frame pivoted at its lower portion to the upper frame, a chain driving wheel on a saddle on said tiltable frame, means for sliding said saddle on said tiltable frame in a direction substantially perpendicular to the rails, an extensible guide post vertically supported by the tiltable frame and positioned below the chain driving wheel, a chain sprocket rotatably connected to the lower end of the guide post, an endless chain extending around the chain sprocket and the chain driving wheel, and a number of cutter bits and a number of agitator bars alternately arranged on the endless chain to form an endless chain cutter;

said method comprising the steps of digging a hole in the ground to a predetermined depth by means of a drilling device, inserting the endless chain cutter of the excavator into the hole, and excavating the ground in a predetermined direction by means of the endless chain cutter, while inserting an agitator substantially similar in construction to the endless chain cutter and having a hardening liquid injection pipe to jet a hardening liquid in the excavated hole, thereby mixing the hardening liquid with the earth and sand in the excavated hole to form a soil cement wall.

5. An underground continuous wall construction method utilizing an excavator comprising a traveling trolley movable on rails and having at least one sprocket in mesh with a rack provided on the rails, driving means for driving the sprocket, an upper frame arranged on the trolley, a tiltable frame pivoted at its lower portion to the upper frame, a chain driving wheel on a saddle on said tiltable frame, means for sliding said saddle on said tiltable frame in a direction substantially perpendicular to the rails, an extensible guide post vertically supported by the tiltable frame and positioned below the chain driving wheel, a chain sprocket rotatably connected to the lower end of the guide post, an endless chain extending around the chain sprocket and the chain driving wheel, and a number of cutter bits and a number of agitator bars alternately arranged on the endless chain to form an endless chain cutter;

said method comprising the steps of digging a hole in the ground to a predetermined depth by means of a drilling device, inserting the endless chain cutter of the excavator into the hole, and excavating the ground in a predetermined direction by means of the endless chain cutter and removing the excavated earth and sand, while inserting an injection pipe behind the endless chain cutter to jet a hardening liquid mixed with the removed earth and sand into the excavated hole, thereby filling the excavated hole with at least one pair of soil and cement or soil and mortar.

6. The underground continuous wall construction method as claimed in claim 3, wherein before the hardening liquid mixed with the earth and sand has hardened, reinforcing members are hung with intervals in the mixture.

7. The excavator as claimed in claim 1, comprising means for adjusting an inclination of said extensible guide post fixed to said tiltable frame, said adjusting means including a hydraulic motor mounted on the upper frame, a screw shaft rotatively driven by the hydraulic motor, a nut threadedly engaged on the screw shaft, and a link connected to the nut and the upper portion of the tiltable frame.

8. The excavator as claimed in claim 1, wherein said means for sliding said saddle on said tiltable frame includes a horizontal base fixed on said tiltable frame, saddle sliding rails provided on said horizontal base and extending in a direction substantially perpendicular to said trolley traveling rails, and a hydraulic cylinder connected between the horizontal base and said saddle on said saddle sliding rails.

9. The excavator as claimed in claim 1, comprising means for adjusting the height of said guide post including a hydraulic winch provided on the tiltable frame and a wire connected to the guide post through a guide pulley from the hydraulic winch, and means for fixing the extensible guide post to the tiltable frame.

* * * * *